United States Patent [19]

Thekdi et al.

[11] 4,120,639

[45] Oct. 17, 1978

[54] HIGH MOMENTUM BURNERS

[75] Inventors: Arvind C. Thekdi, Sylvania; Dennis A. Chojnacki, Toledo; Klaus H. Hemsath, Sylvania, all of Ohio

[73] Assignee: Midland-Ross Corporation, Cleveland, Ohio

[21] Appl. No.: 811,601

[22] Filed: Jun. 30, 1977

[51] Int. Cl.[2] ..... F23R 1/02

[52] U.S. Cl. ..... 431/158; 431/115

[58] Field of Search ..... 431/158, 115, 116, 9, 431/353, 181, 187, 188, 183

[56] References Cited

U.S. PATENT DOCUMENTS

| | | | |
|---|---|---|---|
| 3,480,375 | 11/1969 | Sitte et al. | 431/158 |
| 3,485,566 | 12/1969 | Schuppe | 431/158 |
| 3,749,548 | 7/1973 | Zink et al. | 431/158 |
| 3,836,315 | 9/1974 | Shular | 431/9 |
| 3,905,751 | 9/1975 | Hemsath et al. | 431/183 |

FOREIGN PATENT DOCUMENTS

| | | | |
|---|---|---|---|
| 1,292,930 | 10/1972 | United Kingdom | 431/158 |

*Primary Examiner*—Edward G. Favors
*Attorney, Agent, or Firm*—Harlan E. Hummer

[57] ABSTRACT

A high momentum industrial gas burner designed to create a high velocity which, in turn, is capable of creating high wind circulation that can be maintained during burner turndown. The various chambers of the burner are specially designed, so that fluid pressure within the burner is less than atmospheric pressure, or the fluid pressure within the heating chamber of a furnace wherein the burner is used to heat, for example, air.

12 Claims, 2 Drawing Figures

HIGH MOMENTUM BURNERS

BACKGROUND OF THE INVENTION

The invention is especially suitable for use in a high momentum, or high velocity burner which is designed to produce a high velocity flame or hot combustion products that are capable of creating high wind circulation, even during turndown of the burner. Such burners are intended to be used in high temperature furnaces, such as coil annealing, forging, or pipe heating furnaces, where the mechanical circulation of air is impractical or inefficient. As present, high momentum burners have within the burner block of refractory material, combustion chambers in which the air and fuel are burned. The resulting hot gases are discharged through a small opening with moderate velocity. The fluid pressure within such chambers is greater than atmospheric pressure.

Some of the disadvantages of using existing high momentum burners are, for example, that they require a special ratio control system to maintain a proper air-fuel ratio during turndown of the burner. The resistance and drop of pressure through the flue gas discharge opening changes as the burner firing rate is changed, thereby creating a variable back pressure in the combustion chamber, resulting in a variation of the air-fuel ratio. Moreover, the refractory material of the burning block is highly susceptible to cracking under pressure and, since the burner block or combustion chamber of such burners is greater than atmospheric or furnace pressure, a small crack in the burner block, or a slight leakage of fluid through any one of the many sealed holes communicating with the combustion chamber, can result in hot gas leakage or flame through the cracks. This can damage the burner or the ignition device and eventually reduce the efficiency and effectiveness of usage of the fuel. The invention is directed to overcoming the above deficiencies of currently available high momentum burners.

Briefly stated, the invention is in a high momentum burner wherein a flame or hot products of combustion are discharged at a high velocity, e.g. 300–500 miles per hour (mph). Means are provided for discharging an annular stream of air, under pressure, through an annular orifice at a predetermined velocity. A combustible fuel, such as natural or synthetic gas or oil, is radially directed into the annular stream of air for admixture with the air. A burner insert, having an opening in coaxial alignment with the orifice, coacts with the stream of air and fuel to increase the velocity of the stream through the opening for more intimate contact of the air and fuel and consequent thorough mixing in a first cylindrical chamber which abuts the insert. Means are provided for igniting the fuel in the mixing chamber. A second cylindrical chamber of greater diameter, abuts the first chamber and is designed to increase the temperature of the mixture of fuel and air and stabilize the flame as heated fluid or products of combustion pass through the second chamber. A third cylindrical chamber abuts the second chamber and is designed as a flame tunnel from which hot products of combustion pass at high velocities. The third chamber has a diameter which is greater than that of the first chamber but less than that of the second chamber. The chambers are coaxially aligned with the opening of the insert and are sized relative to each other so as to maintain therein, a fluid pressure which is less than the pressure of the atmosphere into which the flame or hot products of combustion are discharged from the burner.

DESCRIPTION OF THE DRAWING

The following description of the invention will be better understood by having reference to the annexed drawing, wherein.

DETAILED DESCRIPTION OF THE DRAWING

Figure 1:
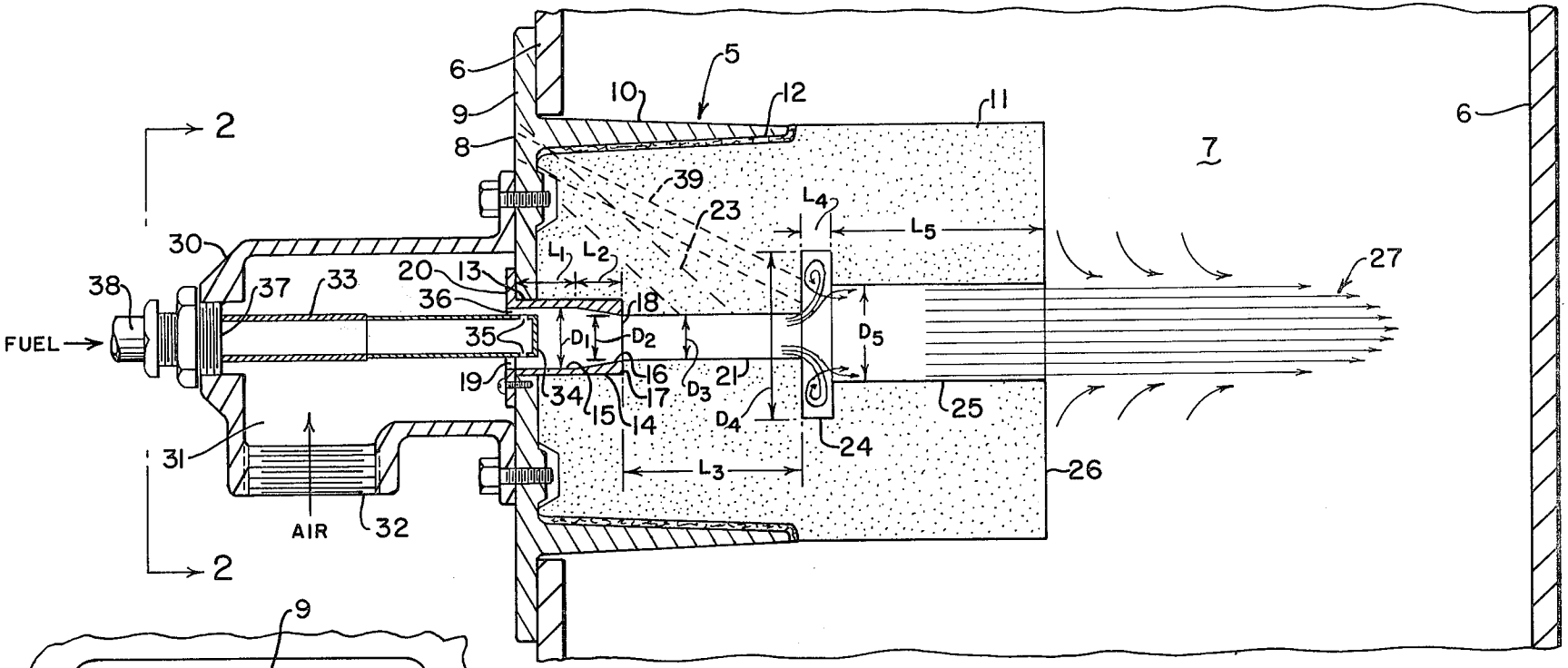
FIG. 1 is a section of a portion of a furnace including a gas burner made in accordance with the invention.

With reference to the drawing, there is shown a high momentum industrial gas burner 5 which is mounted on a furnace 6 having a heat chamber 7 in which air is circulated for heating.

The gas burner 5 comprises a metal body 8 having a rectangular back plate 9 with an outstanding annular or rectangular flange 10. The back plate 9 is firmly bolted to the furnace 6. A cylindrical or rectangular burner block 11, composed of any suitable refractory material, is secured within the flange 10 by any appropriate cement 12. A circular opening 13 is disposed in the back plate 9 and burner block 11 centrally of the annular flange 10. A burner insert or nozzle 14 is secured within the opening 13. The burner insert 14 is provided with a cylindrical passageway 15 having a diameter $D_1$ and length $L_1$ such that the ratio of the diameter $D_1$ to the length $L_1$ is 0.75 to 1.05. The inner walls 16 of the burner insert 14 adjacent the end 17 farthest from the back plate 9, converge in a direction away from the back plate 9 to form a restricted opening 18 which has a diameter $D_2$ which is smaller than the diamteter $D_1$ of the cylindrical passageway 15. The ratio of the diameter $D_1$ to the diameter $D_2$ is 1.05 to 1.15. The length $L_2$ of the converging inner walls 16, measured longitudinally of the insert 14, is such that the ratio of the diameter $D_2$ to the length $L_2$ is 1.25 to 1.55. A plurality of arcuately spaced support arms, e.g. arm 19, extend radially into the cylindrical passageway 15 adjacent the end 20 of the burner insert 14 closest the back plate 9.

A first cylindrical chamber 21 is formed in the burner block 11 in abuting coaxial alignment with the passageway 15 and restricted opening 18 of the burner insert 14. The fuel and air are mixed within this chamber. The first, or mixing chamber 21 has a diameter $D_3$, which is substantially the same as the diameter $D_2$ of the restricted opening 18, and a length $L_3$ such that the ratio of the diameter $D_3$ to the length $L_3$ is 0.25 to 0.3.

Figure 2:
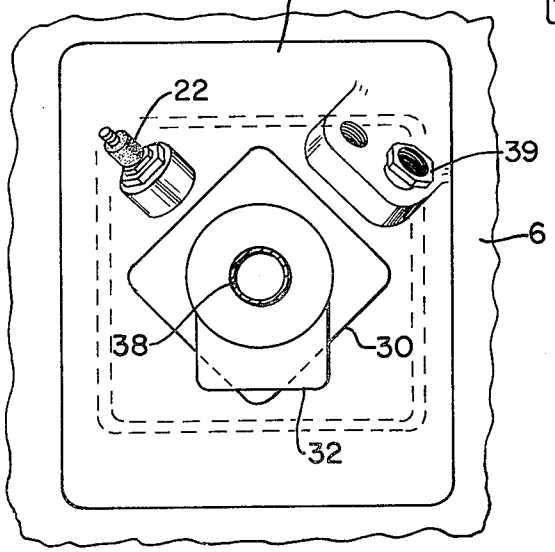
FIG. 2 is a view of the burner and furnace from the line 2—2 of FIG. 1.

A spark plug 22 (FIG. 2) is mounted on the back plate 9 within a spark hole 23 which is angularly disposed in the burner block 11 and communicates with the mixing chamber 21. An electrical current is supplied to the spark plug 22 to cause a spark for igniting the fuel in the mixing chamber 21.

A second cylindrical chamber 24 is formed in the burner block 11 in abuting, coaxial alignment with the mixing chamber 21. The temperature of the mixture of fuel and air is increased within the second chamber 24 by the recirculation of hot gases, as shown, and the flame or products of combustion are stabilized within this chamber 24. The second, or stabilization chamber 24 has a diameter $D_4$ and length $L_4$ such that the ratio of the diameter $D_4$ to the length $L_4$ is 4 to 6. The ratio of the diameter $D_3$ to the diameter $D_4$ is 0.25 to 0.35. Although the diameter $D_4$ of the stabilization chamber 24 is substantially greater than the diameter $D_3$ of the mixing chamber 21, the length $L_4$ is considerably less to maintain a negative pressure within these particular chambers 21,24, i.e. a fluid pressure which is less than the fluid pressure within the heat chamber 7 of the furnace 6.

A third cylindrical chamber 25 is formed within the burner block 11 in abuting, coaxial alignment with the stabilization chamber 24, and extends to the exterior or discharge end 26 of the burner 5. The third chamber 25 acts as a tunnel for the flame 27 or products of combustion which visibly exit from the discharge end 26 as a long narrow flame 27 into the heat chamber 7 of the furnace 6. The flame tunnel 25 has a diameter $D_5$ which is less than the diameter $D_4$ of the stabilization chamber 24, but greater than the diameter $D_3$ of the mixing chamber 21. The ratio of the diameter $D_5$ to the diameter $D_4$ is 0.55 to 0.65. The length $L_5$ of the flame tunnel 25 is such that the ratio of the diameter $D_5$ to the length $L_5$ is 0.4 to 0.5. The successive chambers 21, 24 and 25 are specially sized to maintain a negative pressure within the gas burner 5, so that even if a crack does occur in the burner block 11, the mixture of air and fuel, or the flame, or products of combustion, will not escape through the crack in the burner block 11, or any other small opening in the gas burner 5.

A metal housing 30 is bolted on the back plate 9 in opposite relation from the burner block 11. The housing 30 forms an air chamber 31 having an inlet 32 through which air is pumped under pressure, e.g. 4–5 pounds per square inch (psi), for passage into the burner insert 14.

A fuel nozzle 33 is mounted within the housing 30 in coaxial alignment with the burner insert 14 and mixing chamber 21. One end 34 of the nozzle 33 extends into the passageway 15 of the burner insert 14 and rests on the radial support arms 19 which act to center the nozzle 33 in the passageway 15. A plurality of similar openings, or outlet ports 35, are equally spaced circumferentially around the nozzle 33 adjacent the end 34 which is plugged so that the gaseous fuel, exiting the nozzle 33, moves in a radial direction for contact and mixture with the air exiting from the air chamber 13 into the burner insert 14. The plugged end 34 of the fuel nozzle 33 coacts with the cylindrical walls of the passageway 15 to form an annular orifice 36 through which an annular stream of air, under pressure, enters the burner insert 14 and mixing chamber 21. The other end 37 of the fuel nozzle 33 is coupled to a fuel line 38 through which gas, under pressure, is supplied to the fuel nozzle 33.

The burner 5 is readily adapted to use oil as a fuel, by replacing the gas fuel nozzle 33 with one which is designed to meter oil vapor into the annular air stream.

A sight hole 39 is angularly disposed in the burner block 11 between the back plate 9 and stabilization chamber 24 to visually monitor the products of combustion, or flame within the flame tunnel 25.

Thus, there has been provided a high momentum burner which is readily adaptable to the use of either oil, or natural or artificial gas as a fuel, and whose various chambers are specifically sized to maintain within the burners, a negative fluid pressure, as distinguished from the fluid pressures within existing burners, which latter fluid pressures are greater than atmospheric pressure, or the fluid pressure of the ambient atmosphere surrounding the burner. The flame 27 and entrained hot fluids, or products of combustion, exit from the discharge end 26 of the flame tunnel 25 at relatively high temperatures, e.g. 3000°–4000° F. and at very high velocities, e.g. 300–500 mph, which high velocities cause a radical turbulence of the air or other fluids within the heat chamber 7 of the furnace 6, whereby the air or fluid is quickly heated to the desired temperature. Further, the temperature of the discharing glame 27 and entrained products of combustion entering the heat chamber 7 of the furnace 6, is rapidly reduced to below 2800° F. by such violent action of the turbulent air to keep obnoxious pollutants, such as nitrogen oxide, from being formed. The reduction of obnoxious pollutants such as nitrogen oxide, is an important advantage of using this high momentum burner.

WHAT IS CLAIMED IS:

1. A high momentum burner, comprising:

(a) means for discharging an annular stream of air, under pressure, through an annular orifice at a predetermined velocity; (b) means for radially directing into the stream of air, a combustible fuel for admixture with the air;

(c) a burner insert coacting with the orifice and having an opening coaxially aligned with the orifice, the insert designed to increase the velocity of the stream of air and fuel through the opening, whereby a more intimate contact of the fuel and air is achieved;

(d) a first cylindrical chamber abuting the opening of the insert in spaced relation from the orifice, the first chamber being coaxially aligned with the opening for receiving the air and fuel for further mixing;

(e) means coacting with the second chamber for igniting fuel therein;

(f) a second cylindrical chamber abuting the first chamber and coaxially aligned therewith in spaced relation from the opening of the insert, the diameter of the second chamber being substantially greater than the diameter of the first chamber, the second chamber designed to cause recirculation of gas therein to increase the temperature of the mixture of fuel and air and stabilize the combustion of the fuel; and (g) a third cylindrical chamber abuting the second chamber and coaxially aligned therewith in spaced relation from the first chamber, the third chamber having a diameter greater than the diameter of the first chamber and less than the diameter of the second chamber, the chambers being sized relative to each other to maintain therein, a fluid pressure which is less than the ambient atmosphere into which the flame and any entrained fluid and products of combustion are discharged.

2. The high momentum burner of claim 1, wherein the burner insert has therein a cylindrical passageway for first receiving the mixture of air and fuel, the passageway having a diameter greater than the diameter of the opening of the insert, the insert also having inner surfaces, between the opening and passageway, which converge in the direction of the opening, to form a venturi-like section to increase the velocity of the fuel and air passing into the first chamber.

3. The high momentum burner of claim 2, wherein the means for radially directing a combustible fuel into an annular stream of air, comprises (I) a cylindrical nozzle having a plugged end which extends into the burner insert to form an annular orifice through which the annular stream of air enters into the burner insert, and (II) a plurality of outlet ports, circumferentially spaced about the nozzle adjacent the plugged end, through which the fuel passes radially into the annular stream of air.

4. The high momentum burner of claim 3, which includes a metal back plate and outstanding flange within which the burner insert is centrally disposed, and a burner block composed of refractory material secured within the flange, the coaxially aligned burner insert, and the first, second and third chambers extending centrally through the burner block, the first, second and third chambers being formed by cylindrical passageways in the burner block.

5. The high momentum burner of claim 4, which includes a housing secured to the back plate in opposite relation from the burner block, means mounting the fuel nozzle within the housing in coaxial alignment with the passageway of the burner insert.

6. The high momentum burner of claim 5, which includes means coacting with the housing for pumping air therein at a pressure of from 4–5 pounds per square inch for passage through the annular orifice formed between the fuel nozzle and burner insert.

7. The high momentum burner of claim 6, which includes a sight hole angularly disposed in the burner block between the back plate and second chamber, whereby the flame in the third chamber is observed.

8. The high momentum burner of claim 7, wherein the means for igniting fuel in the first chamber includes a spark hole angularly disposed in the burner block between the back plate and first chamber, a spark plug disposed in the spark hole, and means for causing a spark from the spark plug to ignite at least some of the fuel in the first chamber.

9. The high momentum burner of claim 2, wherein, (I) the ratio of the diameter ($D_1$) of the passageway of the burner insert to the diameter ($D_2$) of the restricted opening of the burner insert is 1.05 to 1.15; (II) the diameter ($D_2$) of the restricted opening of the burner insert is substantially equal to the diameter ($D_3$) of the first chamber; (III) the ratio of the diameter ($D_3$) of the first chamber to the diameter ($D_4$) of the second chamber is 0.25 to 0.35; and (IV) the ratio of the diameter ($D_5$) of the third chamber to the diameter ($D_4$) of the second chamber is 0.55 to 0.65.

10. The high momentum burner of claim 9, wherein (I) the ratio of the diameter ($D_1$) of the passageway of the burner insert to the length $L_1$ of the passageway is 0.75 to 1.05; (II) the ratio of the diameter ($D_2$) of the restricted opening of the burner insert to the length ($L_2$) of the converging surfaces of the burner insert, measured longitudinally of the insert, is 1.25 to 1.55; (III) the ratio of the diameter ($D_3$) of the first chamber to the length ($L_3$) of the first chamber is 0.25 to 0.3; (IV) the ratio of the diameter ($D_4$) of the second chamber to the length ($L_4$) of the second chamber is 4 to 6; and (V) the ratio of the diameter ($D_5$) of the third chamber to the length ($L_5$) of the third chamber is 0.4 to 0.5.

11. The high momentum burner of claim 2, wherein the means (a) for discharing an annular stream of air is designed to discharge from the furnace, a flame and hot gases, including products of combustion, at a velocity which causes a turbulence of fluids sufficient to rapidly cool the hot gases and reduce the temperature of the flame to a point where nitrous oxides won't form.

12. The high momentum burner of claim 11, wherein the means (a) for discharging an annular stream of air includes means for discharing the air such that the flame and hot gases exit the burner at a velocity of from 300 to 500 miles per hour.

* * * * *